US005219060A

United States Patent [19]

Diasparra et al.

[11] Patent Number: 5,219,060

[45] Date of Patent: Jun. 15, 1993

[54] STEP AXLE FOR ESCALATOR

[75] Inventors: Charles D. Diasparra, Rapid City, Ill.; Gerald E. Johnson, Farmington; Arthur M. McClement, Burlington, both of Conn.

[73] Assignee: Otis Elevator Company, Farmington, Conn.

[21] Appl. No.: 705,466

[22] Filed: May 24, 1991

[51] Int. Cl.[5] ..... B66B 23/00

[52] U.S. Cl. ..... 198/326; 198/327

[58] Field of Search ..... 198/321, 326, 327, 333

[56] References Cited

U.S. PATENT DOCUMENTS

| | | | |
|---|---|---|---|
| 951,744 | 3/1910 | Seeberger | 198/326 |
| 1,020,060 | 3/1912 | Seeberger | 198/333 |
| 2,292,534 | 8/1942 | Margles | 198/333 |
| 3,789,972 | 2/1974 | Kraft | 198/333 X |
| 4,726,463 | 2/1988 | Babler | 198/333 |

FOREIGN PATENT DOCUMENTS

| | | | |
|---|---|---|---|
| 0118813 | 9/1984 | European Pat. Off. | 198/326 |
| 354169 | 9/1931 | United Kingdom | 198/326 |

*Primary Examiner*—D. Glenn Dayoan

*Attorney, Agent, or Firm*—William W. Jones

[57] ABSTRACT

The step axle of an escalator is made with an inner, higher strength core piece and an outer, lower strength sleeve. The core is telescoped into the sleeve with opposite ends of the core projecting beyond corresponding outer ends of the sleeve. The step chains and step chain rollers are mounted on the harder outer ends of the core. The higher strength of the core prevents deformation of the composite axle from stresses imparted to the ends of the axle by the chains and rollers. The sleeve with its reinforcement of the core prevents the axle from bending in its center section when loads from the escalator steps are transmitted to the step axle from passengers on the escalator.

4 Claims, 2 Drawing Sheets

STEP AXLE FOR ESCALATOR

DESCRIPTION

1. Technical Field

This invention relates to an improved step axle for an escalator which exhibits greater resistance to stress-induced end deformation and also greater resistance to load-induced medial bending.

2. Background Art

The steps on an escalator are guided along their path of travel by tracks over which rollers mounted on the steps move. The steps are connected together by step chains which engage the step axles of adjacent steps. The step chains are disposed on both sides of the steps and are connected to the opposite ends of the step axles. The step chains thus impart considerable stress to relatively small increments of the step axles, i.e., to their opposite end increments only. Immediately inboard of the step chains, the step axles pass through bushed openings in the sides of the steps, and extend beneath the steps from one side to another. The stresses imparted to the medial portion of the step axles which lie between the sides of the steps are vertical forces resulting from passenger load on the escalator. Thus the ends of the step axles are subject to high localized stressing in the direction of movement of the escalator by the step chains, and the medial portion of the step axles is subjected to vertical stressing resulting from passenger load.

From the above, it will be noted that the step axle has different strength requirements for its ends than it does for its medial part. The ends should be harder than the medial part of the step axle in order to resist bending from the localized bearing stresses imparted to the ends of the step axle by the step axle rollers and step chains. At present, the step axles are formed in one piece with the ends of the axle being machined down to a smaller diameter than the medial portion so as to accept the step rollers and step chains. The smaller end portions of the step axles are hardened so as to increase their wear characteristics. The medial larger diameter portion of the step axle is not hardened. The hardening process has to be monitored to assure that the smaller diameter end portions are hardened uniformly throughout the hardened zone.

DISCLOSURE OF THE INVENTION

This invention relates to an improved escalator or moving walkway step axle which can better resist the stresses imposed on it during operation of the escalator or walkway. The improved step axle has a solid cylindrical core component and a tubular sleeve component telescoped onto the core. The sleeve is shorter that the core so that the ends of the core provide the roller and step chain attachment areas on the step axle. The sleeve provides this extra bulk needed for the medial part of the step axle to support passenger load. The ends of the core are hardened to a length on the core that exceeds the length that each end projects beyond the ends of the sleeve. In this matter, the hardened parts of the core extend inside of the sleeve. The sleeve is not hardened. The hardened parts of the core should have a tensile strength greater than the tensile strength of the sleeve which is approximately 100,000 psi tensile strength to account for the diametrical difference. The design of each component can of course be customized to reflect the extant stress conditions in different escalator systems. Obviously, the entire core could possess the higher tensile strength if desired.

It is therefore an object of this invention to provide an escalator step axle which has improved resistance to bending and fatigue at its end portions.

It is a further object of this invention to provide a step axle of the character described which possesses sufficient medial strength to resist passenger load-induced bending.

It is another object of this invention to provide a step axle of the character described which has higher tensile strength end parts and a lower tensile strength medial part.

These and other objects and advantages of the invention will become more readily apparent from the following detailed description of a preferred embodiment of the invention when considered in conjunction with the accompanying drawings, in which:

BEST MODE FOR CARRYING OUT THE INVENTION

Figure 1:
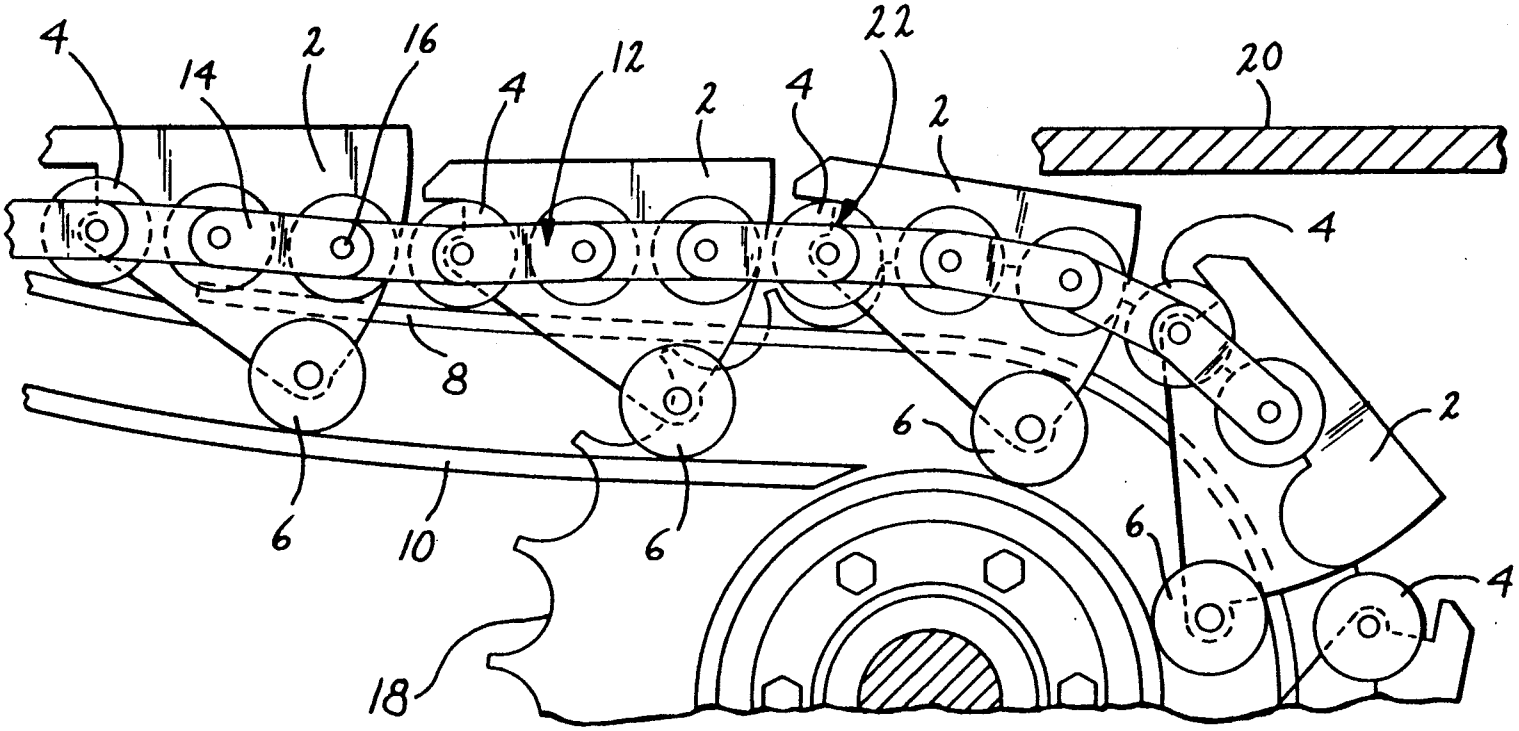
FIG. 1 is a fragmented side elevation view of an escalator landing zone and step turnaround sprocket.

Referring to FIG. 1, the landing and step reversal area of an escalator is shown. The escalator steps 2 include step axle rollers 4 and trailing rollers 6, the former of which move along track 8 and the latter along track 10. The steps 2 are connected together by step chains 12 formed from links 14 joined endwise by pivot pins 16. The steps 2 are guided past a step chain sprocket 18 and move under a landing plate 20. It will be noted that the ends of the step axles, denoted generally by the numeral 22 form the pivot pins for adjacent links of the step chain 12.

Figure 2:
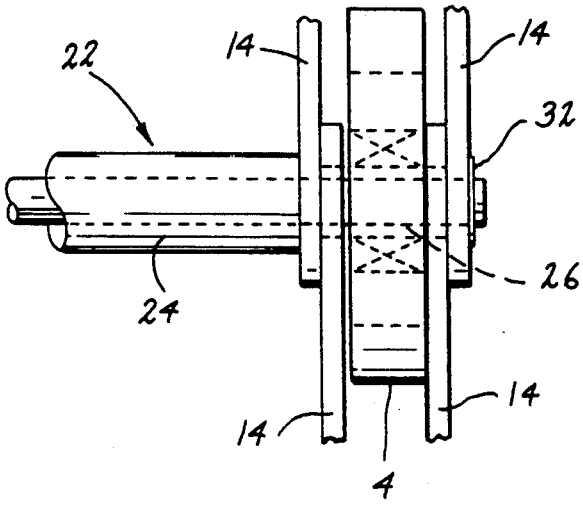
FIG. 2 is a plan view of one end of the step axle showing mounting of the step chain and step chain roller on the reduced diameter end part of the step axle.
Figure 3:
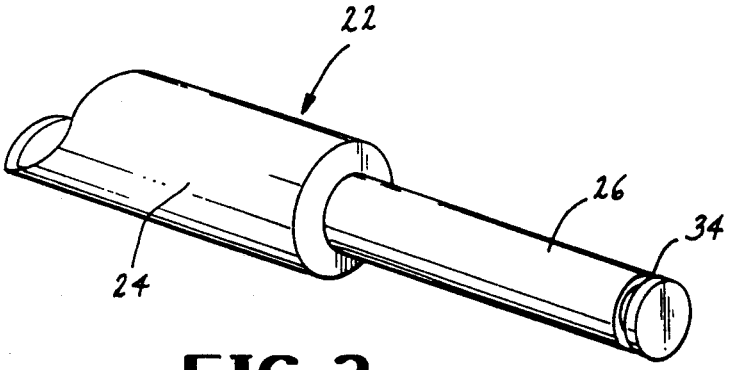
FIG. 3 is a perspective view of one end of the step axle.
Figure 4:
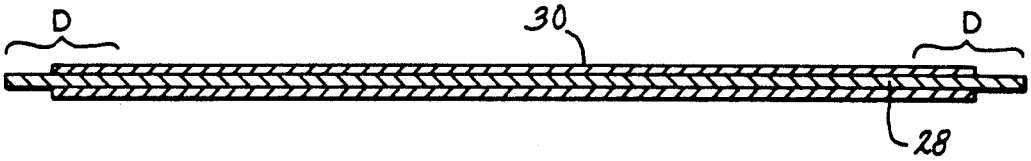
FIG. 4 is a sectional view of the step axle.

Referring to FIGS. 2 and 3, it will be noted that the step axle 22 is formed with a large diameter medial part 24 and reduced diameter end parts 26. The end parts 26 are actually extensions of a core part 28 and the medial enlarged part is actually a sleeve 30 telescoped onto the core 28, as seen in FIG. 4. The step chain links 14 and the roller 4 are fitted onto the small diameter end parts 26 of the step axle 22 and held in place by a snap ring 32 seated in a groove 34. The ends of the core 28 will be hardened to a tensile strength of approximately 150,000 psi for at least a distance D, whereby the hardened ends of the core 28 will extend into the ends of the sleeve 30. The entire core 28 can possess the aforesaid tensile strength if so desired. The sleeve 30, by contrast will have a tensile strength of only about 100,000 psi.

The resultant step axle will have the necessary strength characteristics where needed, and with a safety margin, without necessitating the use of all high tensile strength material, or hardening the entire step axle. The step axle will be easy to produce, can require less machining of the ends, and will be lower in cost than the prior art axles.

Since many changes and variations of the disclosed embodiment of the invention may be made without departing from the inventive concept, it is not intended to limit the invention otherwise than as required by the appended claims.

What is claimed is:

1. An escalator step axle having a cylindrical metal core and an outer metal sleeve telescoped over said core, said core having opposite ends which project beyond corresponding opposite ends of said sleeve, said opposite ends of said core being adapted to be secured to escalator step chains, said ends of said core having a sufficiently high hardness to provide increased wear characteristics and resistance to bending under loads imposed by the step chains and said sleeve having a lower hardness than said ends of said core.

2. The step axle of claim 1 wherein said high hardness ends of said core extend into said sleeve.

3. The step axle of claim 1 wherein a medial portion of said core which is disposed within said sleeve has a lower hardness than said ends of said core.

4. The step axle of claim 3 wherein said sleeve and said medial portion of said core have approximately the same hardness.

* * * * *